United States Patent [19]

Duffin et al.

[11] Patent Number: 4,950,412

[45] Date of Patent: Aug. 21, 1990

[54] FABRIC CONDITIONING COMPOSITION

[75] Inventors: Bryan Duffin; Zia Haq, both of Merseyside, England

[73] Assignee: Lever Brothers Company, New York, N.Y.

[21] Appl. No.: 326,479

[22] Filed: Mar. 20, 1989

Related U.S. Application Data

[63] Continuation of Ser. No. 816,513, Jan. 6, 1986, abandoned.

[30] Foreign Application Priority Data

Jan. 15, 1985 [GB] United Kingdom ..... 8500958

[51] Int. Cl.[5] ..... D06M 9/00; D06M 1/02

[52] U.S. Cl. ..... 252/8.6; 252/8.8; 8/137; 8/115.56; 8/115.65

[58] Field of Search ..... 252/174.23, 8.6, 8.8; 8/137, 115.65, 115.66, 115.56, 115.62

[56] References Cited

U.S. PATENT DOCUMENTS

| | | | |
|---|---|---|---|
| 2,645,584 | 7/1953 | Wiegerink | 106/131 |
| 3,514,321 | 5/1970 | Duncan | 427/242 |
| 3,703,480 | 11/1972 | Grand | 252/543 |
| 3,726,815 | 4/1973 | Grand | 252/106 |
| 3,832,310 | 8/1974 | Grand | 252/524 |
| 3,861,870 | 2/1975 | Edwards et al. | 8/115.6 |
| 3,875,071 | 4/1975 | Grand | 252/544 |
| 3,992,304 | 11/1976 | Minegishi | 252/8.8 |
| 4,051,046 | 9/1977 | Diehl et al. | 252/8.6 |
| 4,149,978 | 4/1979 | Goffinet | 252/8.8 |
| 4,152,272 | 5/1979 | Young | 252/8.8 |
| 4,179,382 | 7/1979 | Procter et al. | 252/8.8 |
| 4,222,922 | 9/1980 | Rees | 260/29.6 BE |
| 4,675,022 | 6/1987 | Danner | 8/115.56 |

FOREIGN PATENT DOCUMENTS

| | | |
|---|---|---|
| 2085 | 5/1979 | European Pat. Off. . |
| 002085 | 5/1979 | European Pat. Off. . |
| 2658575 | 6/1978 | Fed. Rep. of Germany . |
| 2114751 | 6/1972 | France . |
| 2300167 | 3/1976 | France . |
| 58065073 | 3/1976 | Japan . |
| 58004875 | 7/1977 | Japan . |
| 58-004874 | 1/1983 | Japan . |
| 1185283 | 3/1970 | United Kingdom . |
| 1576325 | 10/1980 | United Kingdom . |
| 1604030 | 12/1981 | United Kingdom . |

*Primary Examiner*—Josephine Barr

*Attorney, Agent, or Firm*—Ronald A. Koatz

[57] ABSTRACT

A fabric conditioning composition contains a fabric softening agent, which may be a cationic or nonionic material, and a polymeric drape-imparting agent, such as a vinyl acetate/vinyl chloride copolymer, in the form of positively charged thermoplastic particles having a softening point of 25°-200° C., especially above 50° C. When treated fabrics are ironed above this softening temperature, the particles coalesce to form a drape imparting film on the fabric. Non-ironed fabrics exhibit a softening benefit.

8 Claims, No Drawings

FABRIC CONDITIONING COMPOSITION

This is a continuation of application Ser. No. 815,513 filed Jan. 6, 1986, abandoned.

BACKGROUND TO THE INVENTION

This invention relates to a fabric conditioning composition, in particular a composition for imparting either fabric softness or improved body to the fabric at the discretion of the user.

Fabric conditioning compositions are known which impart fabric softness to fabrics treated therewith. Fabric softness is a property which is most readily apparent in bulked fabrics such as towelling or woolen articles and manifests itself in a softer feel which is achieved inter alia by reducing the rigidity of the fabric construction and improving lubrication between fibres. Fabric softening compositions generally contain a fabric softening agent which is a water-insoluble nonionic, or more usually a cationic compound having one or more long chain alkyl groups, or a mixture of such compounds.

Fabric conditioning compositions are also known which impart increased body or crispness to fabrics treated therewith. This increased body is often referred to as a drape benefit, improved drape resulting from the deposition of starches, waxes and polymeric materials onto the fibres which stiffens the fabric. Drape imparting compositions commonly contain therefore a film forming polymeric material, such as the latex emulsions formed from the polymerisation of vinyl esters, such as poly(vinyl acetate).

The concepts of fabric softness and improved drape are in many respects contradictory. For this reason it has not previously been possible to offer the consumer a product which will provide both increased fabric softness and improved drape.

Further, where the product is in liquid form, the inclusion of both fabric softening agents and drape imparting agents may generate undesired product properties, such as unacceptably high viscosities. German Patent Application No. 2 658 575 (HENKEL) describes a composition containing a quaternary ammonium salt as a cationic softener, an anionic polymer as a drape imparting agent and polyacrylamide as a protective colloid. The use of a protective colloid to reduce the interaction between the cationic softener and the anionic polymer, which might otherwise result in poor product properties and reduced performance, adds to the cost of the product. Further, with a product of this type, all treated fabrics receive the drape benefit. Consequently, bulked fabrics such as towels, for which an increased drape is inappropriate, have to be removed from the treatment medium.

We have now discovered a composition which will provide the consumer with one or other of softening and drape benefits according to the discretion of the user, and which can be provided in a form having acceptable physical properties.

DISCLOSURE OF THE INVENTION

Thus according to the invention there is provided a fabric conditioning composition comprising a nonpolymeric fabric softening agent and positively-charged water-insoluble thermoplastic particles which comprise a polymeric drape-imparting agent and which have a softening point between 25° C. and 200° C.

In the context of the present specification the term "thermoplastic particles" means particles which become soft and plastic when heated and return to the solid state when cooled. The temperature at which the particles soften and coalesce is referred to herein as the "softening point" of the particles. The particles must be substantially water-insoluble, by which in the context of the present specification means having a solubility in water of less than 500 ppm at 25° C. The criteria of thermoplasticity, softening temperature and watersolubility apply to the particles. The particles necessarily contain a polymeric drape-imparting agent and generally such criteria will therefore apply to the drape imparting agent as well. However, this need not necessarily be the case, as the properties of the drape imparting agent may become modified by any other materials which may also be present in the particles.

Such a composition enables the user to select in addition to improved softness, an improved drape by the temperature to which the fabrics are subjected after treatment with the composition. Thus where the fabrics are dried at a temperature below the softening temperature of the thermoplastic particles, the particles do not melt, flow or coalesce to form coated areas on the fabrics which would be necessary to provide improved drape, so that only improved softness results. Where the fabrics are subjected to a temperature which is above the softening temperature, coalescence of the thermoplastic particles occurs which coat the fabric and improved drape results. The higher temperature can be achieved for example by ironing those fabrics for which improved drape is required. By selecting thermoplastic particles having a softening temperature above 25° C., such as above 50° C., but below 200° C., line drying of fabrics will result only in improved softness while subsequent ironing of some selected fabrics at a temperature up to say 200° C. will provide improved drape only on those selected fabrics. Thus the consumer may provide fabric softness on articles such as towels, jumpers and other articles of bulked fabrics while providing improved drape and resistance to creasing on articles such as cotton or polyester sheets and other articles of non-bulked fabrics.

Thus, it is possible to treat fabrics with an aqueous liquor containing a fabric softening agent and positively charged water-insoluble thermoplastic particles which comprise a polymeric drape-imparting agent and which have a softening point between 25° C. and 200° C., separating the washed fabrics from said liquor, drying a first part of the fabric load at a temperature below the softening temperature of said particles thereby to impart fabric softness thereto and ironing a second part of the fabric load at a temperature above the softening temperature of the particles thereby to impart body thereto.

The product may take various forms, but liquid compositions are preferred. These will generally contain the essential ingredients present in an aqueous base or carrier medium. It is preferred that the compositions, particularly when in this form, do not contain high levels of anionic surfactants or electrolytes. By high levels in this context is meant that the compositions should preferably not contain more than 0.4 parts by weight, most preferably not more than 0.2 parts of water-soluble anionic materials per part by weight of fabric softening agent, and also that the compositions should preferably not contain more than 1.0% by weight, most preferably not more than 0.1% electrolyte. Low levels of water-soluble nonionic surfactants can be tolerated in the compositions, preferably provided that the weight thereof does not exceed the weight of the fabric softening agent.

The drape imparting agent is a polymeric material, that is a material which has been made by a method involving polymerisation of unsaturated monomeric materials. The term "non-polymeric" used herein is to be interpreted in a corresponding manner.

The drape imparting agent is preferably present in the form of a latex emulsion, such as may be produced by the emulsion polymerisation of vinyl esters. In this form it is possible to determine the softening temperature of the polymer by coating a metal tube with the emulsion, heating one end of the tube while cooling the other and determining the temperature at the point where film formation just occurs.

To improve compatibility between the ingredients, especially when the fabric softening agent is a cationic fabric softening agent, and the product is in liquid form, it is essential that the thermoplastic particles should be cationic, i.e. should also carry some positive charge. This may be achieved in a simple manner during preparation of the polymer, where the necessary monomer or monomers ar polymerised in the presence of a cationic surfactant.

Alternatively, dispersions of the drape imparting agent may be prepared at a temperature above the melting point in the presence of a cationic surfactant. In this case the cationic surfactant becomes adsorbed or entrapped in the particles, thereby providing them with a positive charge. A still further alternative is to utilise a polymeric material which is derived from at least one cationic monomer, such as vinyl pyridine. Amphoteric polymers can also be used which have an overall positive charge under the pH conditions prevailing in the product. Also, it is possible to provide the particles with a positive charge by utilising a polymer which has been prepared by polymerisation in the presence of a cationic polymerisation initiator.

When the fabric softening agent is a cationic material and/or some other cationic material is present, such as a water-soluble cationic surfactant, and the product is in the form of an aqueous dispersion, the necessary positive charge for the thermoplastic materials can be derived simply from the presence of the cationic species.

Also to improve the stability of the product and its performance, especially when the product is in liquid form, it is preferred that the thermoplastic particles have an average particle size of 0.1 to 200 $\mu$, preferably below 20 $\mu$, most preferably below 2 $\mu$. In this context, particle size is measured by electron microscopy.

The optimum ratio of the fabric softening material to the drape imparting agent depends on the degree of fabric softness and improved drape which is desired. We have found that a weight ratio of 10:1 to 1:10 is suitable, especially 6:1 to 1:6.

The compositions may contain from 1.0% to 25.0%, preferably from 5.0% to 15.0% by weight of the fabric softening agent and from 0.5% to 50%, preferably from 2.5% to 30% by weight of the thermoplastic particles.

SUBSEQUENT REMOVAL OF DRAPE IMPARTING AGENT

After a period of time involving several treatment cycles, the level of drape imparting agent on the fabrics may build up to unacceptably high levels. It is therefore advantageous if the drape imparting agent is such that it will be washed off the fabrics in a subsequent washing process which will involve the use of a high pH and/or anionic surfactants. We have found that this removability can be achieved when the thermoplastic particle includes a material having carboxylic acid groups in its structure.

These carboxylic acid groups can be provided on the drape imparting agent e.g. by utilising a polymer derived from a carboxylic monomer. Alternatively other materials which contain carboxylic acid groups can be entrapped within the thermoplastic particles. The use of an amphoteric material as the drape imparting agent is also possible, where the amphoteric material is such as to generate carboxylic acid groups at higher pH.

References herein to carboxylic acid groups should be taken to include other functional groups, such as carboxylic acid anhydride groups, which are capable of generating carboxylic acid groups in aqueous media.

The proportion of carboxylic acid groups in the thermoplastic particles should be sufficient to render the drape imparting agent at least partially removable from the fabrics.

FABRIC SOFTENING AGENT

The non-polymeric fabric softening agent is a material which is capable of softening fabrics treated with the composition of the invention, and may be a water-insoluble cationic fabric softener which can be any fabric-substantive cationic compound which has a solubility in water at pH 2.5 and 20° C. of less than 10 g/l. Highly preferred materials are quaternary ammonium salts having two $C_{12}$–$C_{24}$ alkyl or alkenyl chains, optionally substituted or interrupted by functional groups such as —OH, —O—, —CONH, —COO—, etc.

Well known species of substantially water-insoluble quaternary ammonium compounds have the formula

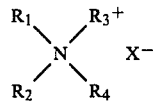

wherein $R_1$ and $R_2$ represent hydrocarbyl groups from about 12 to about 24 carbon atoms; $R_3$ and $R_4$ represent hydrocarbyl groups containing from 1 to about 4 carbon atoms; and X is an anion, preferably selected from halide, methyl sulfate and ethyl sulfate radicals. Representative examples of these quaternary softeners include ditallow dimethyl ammonium chloride; ditallow dimethyl ammonium methyl sulfate; dihexadecyl dimethyl ammonium chloride; di(hydrogenated tallow alkyl) dimethyl ammonium chloride; dioctadecyl dimethyl ammonium chloride; dieicosyl dimethyl ammonium chloride; didocosyl dimethyl ammonium chloride; di(hydrogenated tallow) dimethyl ammonium methyl sulfate; dihexadecyl diethyl ammonium chloride; di(coconut alkyl) dimethyl ammonium chloride. Ditallow dimethyl ammonium chloride, di(hydrogenated tallow alkyl) dimethyl ammonium chloride, di(coconut alkyl) dimethyl ammonium chloride and di(coconut alkyl) dimethyl ammonium methosulfate are preferred.

Another class of preferred water-insoluble cationic materials are the alkylimidazolinium salts believed to have the formula:

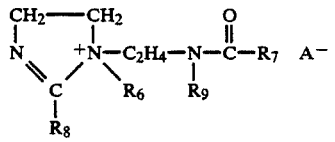

wherein $R_6$ is an alkyl or hydroxyalkyl group containing from 1 to 4, preferably 1 or 2 carbon atoms, $R_7$ is an alkyl or alkenyl group containing from 8 to 25 carbon atoms, $R_8$ is an alkyl or alkenyl group containing from 8 to 25 carbon atoms, and $R_9$ is hydrogen or an alkyl containing from 1 to 4 carbon atoms and $A^-$ is an anion, preferably a halide, methosulfate or ethosulfate. Preferred imidazolinium salts include 1-methyl-1-(tallowylamido-) ethyl -2-tallowyl- 4,5-dihydro imidazolinium methosulfate and 1-methyl-1-(palmitoylamido)ethyl -2-octadecyl-4,5- dihydroimidazolinium chloride. Other useful imidazolinium materials are 2-heptadecyl-1-methyl-1- (2-stearylamido)ethyl-imidazolinium chloride and 2-lauryl-1-hydroxyethyl-1-oleyl-imidazolinium chloride. Also suitable herein are the imidazolinium fabric softening components of U.S. Pat. No. 4 127 489, incorporated by reference.

The fabric softening agent may be, or include, a nonionic fabric softening agent. Suitable examples of nonionic fabric softening agents include fatty acid esters of mono- or polyhydric alcohols, containing from 1 to 8 carbon atoms such as sorbitan esters including sorbitan monostearate and sorbiton tristearate, ethylene glycol esters including ethylene glycol monostearate, glycerol esters including glycerol monostearate, alkyl mono- or di-alkanolamides such as palm or tallow monoethanolamide and tallow diethanolamide, lanolin and derivatives thereof, and other such materials disclosed in GB No. 1 550 206, the disclosure of which is incorporated herein by reference.

Naturally, it is essential that the compositions of the invention do not contain materials which will prevent the fabric softening agent from softening fabrics treated therewith.

DRAPE IMPARTING AGENT

The drape imparting agent may be selected from polymers and copolymers of monomeric materials having the general formula

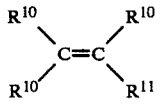

wherein each $R^{10}$ is hydrogen or an alkyl group having 1 to 4 carbon atoms and $R^{11}$ is selected from hydrogen, alkyl or alkoxy groups having 1 to 4 carbon atoms, halogen groups, aryl or alkyl aryl groups, carboxylic acid or carboxylic acid ester groups or an acetoxy group, provided that the resulting thermoplastic particles have the required softening temperature. We have found that suitable monomers include vinyl acetate, vinyl chloride, styrene, butyl acrylate, acrylic acid, methyl methacrylate and mixtures thereof and that particularly suitable polymers having film forming temperatures below 200° C. are 60/40 vinyl acetate/butyl acrylate
60/40 and 40/60 vinyl acetate/vinyl chloride
59.5/39.5/1 and 58.5/38.5/3 vinyl acetate/butyl acrylate/acrylic acid
80/20 and 60/40 styrene/butyl acrylate
80/20 and 60/40 methyl methacrylate/butyl acrylate
80/17/3 styrene or methyl methacrylate/butyl acrylate/acrylic acid; and
39.5/59.5/1 vinyl acetate/vinyl chloride/acrylic acid.

These polymers can be prepared by initiation polymerisation in the presence of a cationic surfactant. Suitable cationic surfactants include water-soluble quaternary ammonium salts and imidazolinium salts such as coconut alkyl polyethoxy methyl ammonium methosulphate (Rewoquat CPEM ex REWO Chemicals Limited).

OPTIONAL INGREDIENTS

In addition to the fabric softening agent and the drape imparting agent the compositions of the invention may include any one or more of the following optional ingredients: electrolytes, particularly the ionic salts of calcium, magnesium or aluminium; solvents, particularly $C_1$–$C_4$ alkanols and polyhydric alcohols; pH buffering agents such as weak acids e.g. phosphoric, benzoic or citric acids (the pH of the compositions in liquid form are preferably less than 8.0, usually less than 6.0); antigelling agents; viscosity modifiers; perfumes; perfume deposition aids such as amines; fluorescers; colourants; hydrotropes; antifoaming agents; antiredeposition agents; enzymes; optical brightening agents; opacifiers; stabilisers such as guar gum and polyethylene glycol; anti-shrinking agents, further drape imparting agents; anti-spotting agents; soil release agents; germicides; fungicides; anti-oxidants; anti-corrosion agents; preservatives; dyes; bleaches and bleach precursors; and antistatic agents.

EXAMPLES

The invention will now be illustrated by the following non-limiting examples.

EXAMPLE 1

Three compositions having the following formulations were prepared.

| | Example No | | |
|---|---|---|---|
| | 1 | A | B |
| Dihardened tallow dimethyl ammonium chloride (Arquad 2HT) | 4.5% | 4.5% | — |
| 60/40 vinyl acetate/vinyl chloride polymerised in the presence of Rewoquat CPEM[1] | 2.5% | — | 2.5% |
| Water | | balance | |

[1]Softening temperature 50° C.

This composition was used to condition a fabric load consisting of a mixture of terry towelling and polycotton sheeting. The dosage level was 5 mls of product added per litre of treatment liquor. The liquor to cloth ratio was 30:1. The fabrics were treated with the liquor for 5 minutes at 20° C. After removal from the liquor the fabrics were spun dry. The terry towelling was assessed for softness by panel subjective judgement against a scale of softened standards on a 2–14 scale where 8 represents desized terry towelling, 2 represents the softness obtained by a rinse in COMFORT (Trade Mark) commercially available fabric softening composition at its recommended dosage and 14 represents multiwash towelling without a rinse treatment. The dried polycotton sheeting was assessed for drape by a CUSICK drapemeter (ex James H Heal & Co Limited, England) using 30 cm diameter fabric circles cut from the rinse treated polycotton pieces. Following the initial drape assessment the polycotton pieces were ironed at 140° C. and reassessed for drape.

| | Example No | | | |
|---|---|---|---|---|
| | 1 | A | B | C[2] |
| Softness | +4.4 | +4.9 | −0.6 | 0 |
| Drape before ironing (%) | 60 | 61 | 62 | 64 |
| Drape after ironing (%) | 66 | 63 | 69 | 62 |
| Δ% drape | +6 | +2 | +7 | −2 |

[2]Example C was a control where no product was used.

These results demonstrate that with the product of the invention, Example 1, improved softness relative to the no-product control, Example C was obtained, no drape benefit relative to Example C occurred until the fabrics were ironed. Example A demonstrates that no significant drape benefit occurs in the absence of the film-forming polymer, while Example B demonstrates that no fabric softening benefit occurs in the absence of the fabric softening agent.

EXAMPLE 2

Three compositions having the following formulations were prepared.

| | Example No | | |
|---|---|---|---|
| | 2 | D | E |
| Dihardened tallow dimethyl ammonium chloride (Arquad 2HT) | 4.5% | 4.5% | — |
| 60/40 vinyl acetate/vinyl chloride polymerised in the presence of Rewoquat CPEM[3] | 2.0% | — | 2.0% |
| Water | | balance | |

[3]Polymer softening temperature 50° C.

This composition was used to condition a fabric load consisting of a mixture of terry towelling and polycotton shirting. The dosage level was 5 mls of product added per litre of treatment liquor. The liquor to cloth ratio was 30:1. The fabrics were treated with the liquor for 5 minutes at 20° C. After removal from the liquor, the fabrics were spun and line dried. The terry towelling was assessed for softness and the polycotton for drape as described in Example 1.

Following the initial drape assessment the polycotton shirting pieces were ironed at 130° C. and reassessed for drape.

The results were as follows.

| | Example No | | | |
|---|---|---|---|---|
| | 2 | D | E | F[4] |
| Softness | +3.9 | +5.1 | −0.3 | 0 |
| Drape before ironing (%) | 42 | 47 | 45 | 53 |
| Drape after ironing (%) | 66 | 57 | 74 | 54 |
| Δ% drape | +24 | +10 | +29 | +1 |

[4]Example F was a control where no product was used.

EXAMPLE 3

EFFECT OF PRODUCT DOSAGE

A composition was prepared as follows:

| | |
|---|---|
| Dihardened tallow dimethyl ammonium chloride (ARQUAD 2HT) | 4.5% |
| Polymer as in Example 2 | 5.0% |
| Water | Balance |

A mixed fabric load was treated in a 5 minute rinse cycle with the product dosage being 5 mls added per litre of treatment liquor. In subsequent treatments the product dosage was changed to give half this "normal" dosage, 1½ times normal and 2×normal treatment dosage. Assessment of drape and softness, as described in Example 1, gave the following results:

| | Example | | | | |
|---|---|---|---|---|---|
| | No treatment control | ½ normal dose | normal dose | 1½ × normal dose | 2 × normal dose |
| Softness | 0 | +4.2 | +4.3 | +4.1 | +4.5 |
| Drape before ironing % | 64 | 61 | 59 | 57 | 58 |
| Drape after ironing % | 62 | 67 | 66 | 75 | 77 |
| Δ% drape | −2 | +6 | +7 | +18 | +19 |

EXAMPLES 4 to 9

Compositions were prepared having the following formulations:

| | EXAMPLE NO | | | | | | |
|---|---|---|---|---|---|---|---|
| | 4 | 5 | 6 | 7 | 8 | 9 | G |
| Dihardened tallow dimethyl ammonium chloride (Arquad 2HT) | 9% | — | 9% | | 9% | — | 9% |
| 40/60 vinyl acetate/vinyl chloride polymerised in the presence of Rewoquat CPEM[5] | 20% | 20% | — | — | — | — | — |
| 80/20 Styrene/butylacrylate polymerised in the presence of of Rewoquat CPEM[6] | — | — | 20% | 20% | — | — | — |
| 80/20 methyl methacrylate/ butyl acrylate polymerised in the presence of Reqoquat CPEM[7] | — | — | — | — | 20% | 20% | — |
| Water | | | | balance | | | |

[5]polymer softening temperature 55° C.
[6]polymer softening temperature 65° C.
[7]polymer softening temperature 65° C.

The compositions were used to treat fabric loads consisting of terry towelling and polycotton sheeting. The dosage level was 5 mls of product per litre of treatment liquor. The polycotton fabric was assessed for drape before and after ironing, as described in Example 1, and the results were as follows:

| | EXAMPLE NO | | | | | | | |
|---|---|---|---|---|---|---|---|---|
| | 4 | 5 | 6 | 7 | 8 | 9 | G | H[8] |
| Drape before ironing % | 56 | 61 | 51 | 57 | 62 | 58 | 58 | 61 |
| Drape after ironing % | 76 | 82 | 67 | 73 | 66 | 72 | 61 | 61 |
| Δ% drape | 20 | 21 | 15 | 16 | 4 | 14 | 3 | 0 |

[8]Example H was a control in which no treatment was given to the fabrics.

EXAMPLE 10 (COMPARATIVE)

A composition was prepared having the following formulation:

| | Example No 10 |
|---|---|
| Dihardened tallow dimethyl ammonium chloride (Arquad 2HT) | 9% |
| 60/40 vinyl acetate/butyl acrylate polymerised in the presence of Rewoquat CPEM[9] | 20% |
| Water | balance |

[9]Polymer softening temperature 8° C.

The composition was used to treat fabric at a dosage of 5 mls per litre of treatment liquor. An equivalent fabric load was treated with the composition of Example 4 used at the same dosage. After removal from the treatment liquids, both loads were spun and line dried. Following drying, the drape a-d softness was assessed as in Example 1. Finally, the polyester cotton portions of each load were given an ironing at the cotton setting (about 150° C.) and the drape values redetermined. The results are as follows:

| | Example No | | Water |
|---|---|---|---|
| | 10 | 4 | Control |
| Softness - line dried | +4.4 | +5.0 | 0 |
| Drape before ironing - line dried (%) | 65 | 56 | 61 |
| Drape after ironing - line dried (%) | 68 | 76 | 64 |
| Δ% drape | +3 | +20 | +3 |

The results show that the increase in drape which occurs after ironing in the case of Example 10 is no more than occurs with a water only treatment, in comparison with Example 4 where a significant increase in drape occurs after ironing. This demonstrates the effect of using a drape-imparting agent with a softening temperature above room temperature.

EXAMPLE 11

REMOVAL DURING WASHING

To improve the removal of the drape effect in a subsequent wash, a composition was prepared in which the polymer component was a termpolymer consisting of methyl methacrylate, butyl acrylate and acrylic acid in a weight ratio of monomers of 80/17/3. The corresponding composition in which the acrylic acid is omitted from the polymerisation was also prepared (Example 8).

| | Example No | |
|---|---|---|
| | 11 | 8 |
| Dihardened tallow dimethyl ammonium chloride (Arquad 2HT) | 9% | 9% |
| 80/17/3 methyl methacrylate/butyl acrylate/acrylic acid polymerised in the presence of Rewoquat CPEM | 20% | — |
| 80/20 methyl methacrylate/butyl acrylate polymerised in the presence of Rewoquat CPEM | — | 20% |
| Water | balance | |

After treating fabric loads with the compositions used at 5 g per litre of treatment liquor, polyester cotton fabric pieces were assessed for drape, as in Example 1, after drying and again after ironing. The fabric pieces were then washed at 45° C. for 15 minutes using PERSIL AUTOMATIC (Trade Mark) which is a commercially available fabric washing powder. After line drying they were reassessed for drape and then ironed and again assessed.

The results were as follows:

| | Example | |
|---|---|---|
| | 11 | 8 |
| Drape after rinse treatment - not ironed (%) | 60 | 53 |
| Drape after rinse treatment - ironed (%) | 68 | 63 |
| Δ% drape (initial) | 8 | 10 |
| Drape after washing - not ironed (%) | 58 | 53 |
| Drape after washing - ironed (%) | 59 | 64 |
| Δ% drape after washing | 1 | 11 |
| % removal (R) | 87% | −10% |

The percentage removal of the drape benefit through washing (R) is determined by $$R = 100 - \frac{\Delta\ \%\ \text{drape after washing}}{\Delta\ \%\ \text{drape (initial)}} \times 100\%$$

The increased removal of composition of Example 11 is attributed to the incorporation of acrylic acid in the polymer.

EXAMPLE 12

DIFFERENT FABRICS

Composition of Example 4 was used to treat different fabrics at a dosage of 2.5 g per litre of treatment liquor. After line drying the fabrics were assessed for drape as in Example 1.

| | Example 4 | | Water Control | |
|---|---|---|---|---|
| | Polyester staple | Nylon | Polyester staple | Nylon |
| % drape before ironing | 39 | 39 | 43 | 52 |
| % drape after ironing | 69 | 48 | 52 | 42 |
| Δ% drape | +30 | +9 | +9 | −10 |

| | Example 4 50/50 polycotton | Water Control 50/50 polycotton |
|---|---|---|
| % drape before ironing | 57 | 59 |
| % drape after ironing | 69 | 63 |
| Δ% drape | +12 | +4 |

These results demonstrate the benefit of the invention with all the fabrics tested in comparison with the water-only treatment.

EXAMPLES 13 AND 14

ALTERNATIVE MEANS OF REMOVAL

Stearic acid (0.6 g) and polymer latex 80/20 methyl methacrylate/butyl acrylate, 50% solids (19.4 g) were weighed into separate beakers, heated gently until the stearic acid melted and then were combined with stirring. At about 40° C., 80 mls of cold demineralised water was added and the solution soniprobed for 5 minutes. This composition, Example 13, was formulated to contain additionally 1.5% of dihardened tallow dimethyl ammonium chloride (Arquad 2HT). After the treatment of mixed fabric loads the polyester cotton portion was assessed for drape, as in Example 1, then ironed and reassessed. The fabric pieces were then washed in PERSIL AUTOMATIC fabric washing powder used at the recommended dosage and the drape was remeasured. After re-ironing the pieces the drape values were again fully assessed. The percentage removal of the drape benefit was determined from the differences between the ironed and unironed state following rinse treatment or wash treatment (as in Example 11).

The results were as follows:

| | Example No | |
|---|---|---|
| | 13 | 14 |
| Drape after rinse - unironed % | 59 | 52 |
| Drape after rinse - ironed % | 74 | 70 |
| Δ% drape (initial) | +15 | +18 |
| Drape after wash - unironed % | 57 | 53 |
| Drape after wash - ironed % | 66 | 67 |
| Δ% drape after washing | +9 | +14 |
| % removal | 40% | 22% |

Example 14 is the composition of Example 13 with the stearic acid omitted.

EXAMPLE 15

AMPHOTERIC LATEX

An amphoteric latex styrene/dimethyl amino ethyl methacrylate/methacrylic acid (84/8/8% by volume) was prepared. A composition containing quaternary softener material and the amphoteric latex was formulated as follows:

| | |
|---|---|
| Dihardened tallow dimethyl ammonium chloride (Arquad 2HT) | 4.5% |
| Styrene/dimethyl aminethyl methacrylate/ methacrylic acid (84/8/8% volume) | 20.0% |
| Water | balance |

A polyester cotton fabric load was treated in a 5 minute rinse cycle with the product dosage being 10 mls added per litre of treatment liquor. After squeezing and line drying the fabric was assessed for drape before and after ironing, as in Example 1. Following washing with PERSIL AUTOMATIC at 45° C. the drapes were reassessed before and after ironing.

The results were as follows:

| | Example No 15 |
|---|---|
| Drape after rinse - unironed % | 59 |
| Drape after rinse - ironed % | 72 |
| Δ% drape (initial) | +13 |

-continued

| | Example No 15 |
|---|---|
| Drape after wash - unironed % | 61 |
| Drape after wash - ironed % | 60 |
| Δ% drape after washing | −1 |
| % removal | 108 |

EXAMPLE 16

NONIONIC SOFTENER

The following compositions were prepared. The nonionic fabric softener was sorbitan monostearate in the form of SPAN 60 (Trade Mark) ex Atlas Chemicals. The drape imparting agent was 80/17/3 methyl methacrylate/butyl acrylate/acrylic acid polymerised in the presence of REWOQUAT CPEM (ie a cationic polymer latex). The compositions also contained an emulsifying agent in the form of polyoxyethylene (4) sorbitan monostearate, TWEEN 61 (Trade Mark) ex Honeywill Atlas. These compositions were assessed for performance in the manner described in Example 1.

| | EXAMPLE NO: | | | |
|---|---|---|---|---|
| Ingredients % | 16 | I | J | Water Control |
| SPAN 60 | 9.0 | 9.0 | — | — |
| TWEEN 61 | 1.0 | 1.0 | — | — |
| Drape imparting agent | 20.0 | — | 20.0 | — |
| Water | | balance | | |
| Results | | | | |
| Softness | +1.0 | +1.1 | −1.1 | 0 |
| Drape before ironing (%) | 53.4 | 53.8 | 63.1 | 51.0 |
| Drape after ironing (%) | 65.0 | 45.1 | 74.1 | 47.0 |
| Δ% Drape | +11.6 | −8.7 | +11.0 | −4.0 |

These results demonstrate that only with the product of Example 16 is both a softening benefit and a drape benefit obtainable.

Similarly beneficial results can be obtained when the drape imparting agent used in Example 16 is replaced by a nonionic drape imparting agent such as a polystyrene latex stabilised by a nonionic synthetic colloid and containing 15% dibutyl phthalate (VINAMUL 7715—Trade Mark—ex Vinyl Products Ltd) together with a cationic surfactant such as trimethyl octadecyl ammonium chloride (ARQUAD 18—Trade Mark—ex AKZO Chemie). In this case a suitable level for the cationic surfactant in the product is 0.5% when the drape imparting agent is present at 20%.

We claim:

1. A fabric conditioning composition comprising (1) an aqueous base, (2) a non-polymeric fabric softening agent selected from the group consisting of cationic and nonionic fabric softening agents, and (3) positively charged water-insoluble thermoplastic particles which comprise a polymeric drape imparting agent selected from polymers and copolymers of monomeric materials having the general formula:

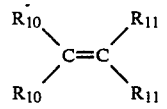

wherein each $R_{10}$ is hydrogen or an alkyl group having 1 to 4 carbon atoms and $R_{11}$ is selected from the group consisting of hydrogen, alkyl or alkoxy groups having 1 to 4 carbon atoms, halogen groups, aryl or alkyl aryl groups, carboxylic acid or carboxylic acid ester groups and acetoxy groups, and which have a softening point between 25° C. and 200° C.

2. A composition according to claim 1, wherein the drape imparting agent has a softening point of above 50° C.

3. A composition according to claim 1, wherein said polymeric drape imparting agent is formed by polymerisation in the presence of a cationic surfactant or a cationic polymerisation initiator.

4. A composition according to claim 1 wherein said polymeric drape imparting agent is derived from at least one cationic monomer.

5. A composition according to claim 1, wherein said polymeric drape imparting agent is amphoteric and has an overall positive charge under the pH conditions prevailing in the composition.

6. A composition according to claim 1, wherein the thermoplastic particles have an average particle size of 0.1 to 200 microns.

7. A composition according to claim 1, wherein the weight ratio of the fabric softening material to the drape imparting agent is from 10:1 to 1:10.

8. A composition according to claim 1, wherein the thermoplastic particle includes a material having carboxylic acid groups in its structure or groups capable of generating carboxylic acid groups in aqueous media.

* * * * *